US009428203B2

(12) United States Patent
Szprynger

(10) Patent No.: US 9,428,203 B2
(45) Date of Patent: Aug. 30, 2016

(54) DEVICE FOR RECEIVING, PROCESSING AND GENERATING SIGNALS FOR AUTOMATICALLY CONTROLLING A RAIL VEHICLE

(71) Applicant: Wojciech Szprynger, Wroclaw (PL)

(72) Inventor: Wojciech Szprynger, Wroclaw (PL)

( * ) Notice: Subject to any disclaimer, the term of this patent is extended or adjusted under 35 U.S.C. 154(b) by 0 days.

(21) Appl. No.: 14/422,647

(22) PCT Filed: Aug. 28, 2013

(86) PCT No.: PCT/PL2013/000110

§ 371 (c)(1),
(2) Date: Feb. 26, 2015

(87) PCT Pub. No.: WO2014/035268

PCT Pub. Date: Mar. 6, 2014

(65) Prior Publication Data

US 2015/0175180 A1 Jun. 25, 2015

(30) Foreign Application Priority Data

Sep. 3, 2012 (PL) ..... 400632

(51) Int. Cl.

| | |
|---|---|
| ***B61L 3/12*** | (2006.01) |
| ***B61L 3/00*** | (2006.01) |
| ***B61L 25/02*** | (2006.01) |
| ***B61L 15/00*** | (2006.01) |
| ***B61L 27/04*** | (2006.01) |

(52) U.S. Cl.

CPC ..... *B61L 27/04* (2013.01); *B61L 3/008* (2013.01); *B61L 3/125* (2013.01); *B61L 15/0027* (2013.01); *B61L 25/025* (2013.01); *B61L 2205/02* (2013.01); *B61L 2205/04* (2013.01)

(58) Field of Classification Search

CPC .... B61L 3/008; B61L 27/04; B61L 15/0027; B61L 25/025; B61L 3/125; B61L 2205/02; B61L 2205/04

USPC ..... 701/2, 19, 20, 36, 70, 93, 300, 301; 246/167 R, 182 R, 182 B, 167 D

See application file for complete search history.

(56) References Cited

U.S. PATENT DOCUMENTS 5,757,291 A * 5/1998 Kull ..... B61L 23/34 246/122 R
2008/0315044 A1 12/2008 Stull
2013/0325211 A1 12/2013 El Fassi

FOREIGN PATENT DOCUMENTS

DE 102011002772 7/2012
EP 1674371 6/2006

(Continued)

*Primary Examiner* — Russell Frejd
(74) *Attorney, Agent, or Firm* — Cherskov Flaynik & Gurda LLC

(57) ABSTRACT

A device for receiving, processing and generating signals for automatically controlling a rail vehicle with a receiving module; a transmitting module; a speedometer module; an RFID module; and a braking module. The controller comprises a programmable logic controller and wherein said controller is connected to the receiving module, the transmitting module, the speedometer module, the RFID module; and the braking module. The receiving module is in the form of a GPS receiver wherein said transmitting module is in the form of a GSM modem wherein said transmitting module receives signals from a traffic dispatch server. The speedometer module comprises a speedometer wherein said RFID module comprises an RFID aerial. The braking module receives signals from the brake in the rail vehicle and transmits same to the controller as well as receives signals from the controller to the braking system.

5 Claims, 1 Drawing Sheet

(56) References Cited

FOREIGN PATENT DOCUMENTS

| | | |
|---|---|---|
| EP | 2210791 | 7/2010 |
| GB | 2392983 | 3/2004 |
| WO | WO 2011/125074 | 10/2011 |
| WO | WO 2013/009555 | 1/2013 |

* cited by examiner

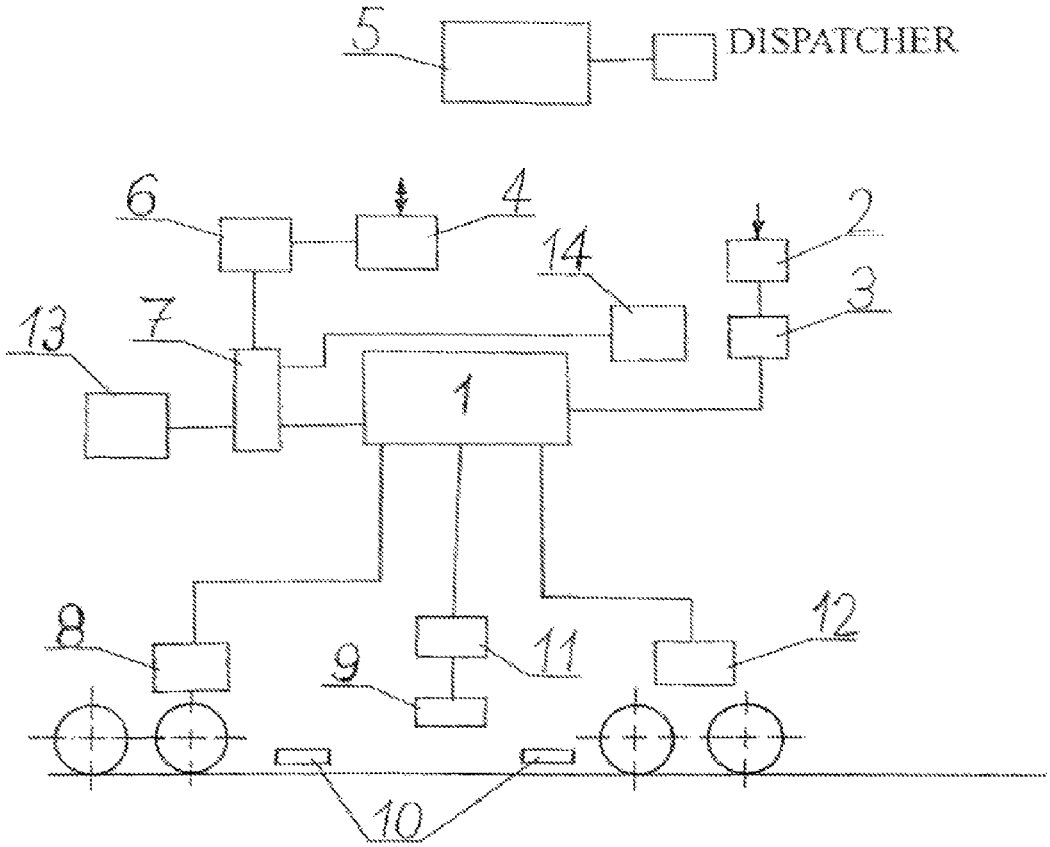
5
DISPATCHER
6
4
2
14
3
13
7
1
8
11
12
9
10

DEVICE FOR RECEIVING, PROCESSING AND GENERATING SIGNALS FOR AUTOMATICALLY CONTROLLING A RAIL VEHICLE

PRIORITY

This application claims the benefits of priority as the nationalization of international application PCT/PL2013/000110, filed on Aug. 28, 2013, currently pending, which in turn claimed priority benefit of Polish Patent Application P.400632, filed on Sep. 3, 2012, currently patented as Polish Patent Number PAT.219427.

The object of the invention is a device for receiving, processing and generating signals for automatically controlling a rail vehicle in order to guide it safely along a planned route.

In order to safely guide trains along planned routes, the European Train Control System, designated in brief as ETCS has been developed as a system for automatically controlling a train. In the future, this system should standardize and simplify the equipment of railway line sections and rail vehicles as well as border crossings between countries, which use different systems for automatically controlling a train. The Eurobalise data transmission system is used in the introduction stage or in a transitional stage, also in the existing systems for automatically controlling a train, which are specific for a given country.

A device and a method is known for receiving and processing signals for automatically controlling a train in a rail vehicle as well as a receiving device described in the EP 2181908 patent specification. This device comprises a receiving device for receiving signals from track-side transmission devices, the first on-board computer of the first system for controlling a train, which is connected with the receiving device by means of the first communication interface and a second on-board computer of a second system for automatically controlling a train. This device is characterised in that it comprises an emulator for connecting the second on-board computer with a receiving device and for simulating from the second on-board computer a second receiving device, connected with the second on-board computer by means of the second communication interface. The receiving device is adapted for transmitting information relating to the received signals to the first on-board computer and to the second on-board computer. However, the emulator is adapted for tuning the information transmitted to the second on-board computer to the second communication interface.

The method of receiving and processing the signals of automatically controlling a train in a rail vehicle, in which the signals from the track-side transmission devices are received by the receiving devices and the information relating to the received signals are transmitted by the receiving device to the first on-board computer of the first system for automatically controlling a train. A computer is connected to the receiving device by means of the first communication device and the information is also transmitted to the second onboard computer of the second system for automatically controlling a train. A system is connected to the receiving device by means of the second communication interface. The information transmitted to the second on-board computer is tuned to the second communication interface before being transmitted. According to the invention, the device for receiving, processing and generating signals for automatically controlling a rail vehicle comprises a controller connected to a receiving module and to a transmitting module.

This device is characterised in that it has the first receiving module in the form of a GPS receiver, it has a second receiving module in the form of a GSM modem, it has a third receiving module in the form of a speedometer, it has a fourth receiving module in the form of an RFID aerial and it has a fifth receiving module in the form of a braking unit, where the second, the fourth and the fifth receiving modules simultaneously exchange information with the controller module and whereas all modules are connected to the PLC controller. The controller is connected to the GSM modem by means of a signal branch joint and a converter in the form of a RS232 converter. The controller is connected to the GPS receiver by means of a signal converter in the form of the RS232 converter.

The controller is connected to the RFID aerial by means of a box comprising an RFID reader connected to the RS232 converter. The branch joint is connected to two separate terminals.

The device according to the invention ensures safe and collision-free travel of the rail vehicle leading the train along the planned route. The device according to the invention detects the dangerous distance to an obstacle, which may be another rail vehicle, moving on the same route and it activates the train braking system even if the train operation personnel does not perform this action. Furthermore, the device detects an excessive speed of the train both in relation to the permissible speed set for the given section and an excessive speed in relation to the expected braking distance.

The device according to the invention will be explained in more detail in the embodiment and on the drawing on which, on FIG. 1, the device is shown in a schematic way.

As it is shown on FIG. 1, the device is comprised of the controller 1, which is the PLC controller, connected with many modules, including the receiving modules and the transmitting modules. The first receiving module 2 in the form of the GPS receiver is connected to the controller 1 by means of a signal converter 3 in the form of the RS 232 converter, which amplifies the signal and tunes it to the device, in the form of the PLC controller 1 receiving this signal. The GPS receiver receives signals about the location of the rail vehicle from a satellite system. The PLC controller reads the information from the GPS receiver every 1 sec, which makes it constantly receive the information about the vehicle location. The second receiving module 4 is the GSM modem, which receives signals from the server 5 at the traffic dispatcher workstation and transmits it to the controller 1 by means of the signal converter 6, in the form of the RS232 converter, and the branch joint 7. The third receiving module 8 is the speedometer, which measures the speed of the rail vehicle and transmits the value of this speed to the controller 1. The fourth receiving module 9 is the RFID aerial, which receives signals from the controller 1 and therefore activates the track-side transmission devices 10 in the form of TAG RFID, located between the rail tracks. The activated track-side transmission devices 10 transmit signals to the RFID aerial located on the rail vehicle and the received signals are transmitted to the controller 1 by means of the box 11 comprising the RFID reader connected to the RS232 converter. The fifth receiving module 12 is the braking unit which receives signals from the brake in the rail vehicle, especially the signals about the air pressure value in the main line and transmits it to the controller 1. Simultaneously, the braking unit 12 receives signals from the controller 1 and influences the air pressure value in the main line, that is, braking by the train or its absence. Furthermore, the controller 1 is connected with two terminals 13 and 14 by means of the branch joint 7.

The device according to the invention is responsible for actively assisting the train driver from starting to stopping at the target station. Before setting off along the route, the driver enters the information received at the station, e.g. the train number, the line number, the actual weight of the train into the terminal. Plugging an USB memory stick pen drive, which will have all necessary data saved in it, into a USB socket of the controller 1 instead of said information entry, is possible. After setting off, the controller 1 displays on the terminal 14 the information for the train driver about the length of the length of rail made available after an earlier passing train, which is on the same rail line. The same information is displayed on the terminal 13, which is provided for the driver's assistant. The use of the terminal 13 is optional, in which case the branch joint 7 is not active. Furthermore, the length of the braking distance, for the speed, at which the train moves, is displayed on the terminal 14. In case of an excessive speed and lack of the train driver's reaction, the controller 1 sends a signal to the braking unit 12, which turns on a respective air bleeder in the main line and therefore the train braking system is turned on. The device computes the train braking distance, taking its weight and current speed into account, at the characteristic places of the given railway line, such as the last kilometers left to the speed limit spot or train stop. When the train develops an excessive speed, the "slow down" message appears on the terminal 14. If the device does not confirm the reduction of the train speed, the controller 1 sends a signal to the braking unit 12, which executes the program of reaching the speed required by the controller 1 or stopping the train.

Trains equipped with the device according to the invention send their location information to the server 5 via the GSM system. The information about the foregoing train is downloaded from the server 5 by means of the GPS system and sent to the controller 1. In case the distance is confirmed to be smaller than the pre-set minimum, the controller 1 signals an alarm on the terminal 14. If the train driver does not react properly within 10 seconds to the provided information, the controller 1 sends a proper signal to the braking unit 12, which will make the train start braking.

The invention claimed is:

1. A device for receiving, processing and generating signals for automatically controlling a rail vehicle, comprising:

a receiving module; a transmitting module; a speedometer module; an RFID module;

and a braking module a controller wherein said controller comprises a programmable logic controller and wherein said controller is connected to said receiving module, said transmitting module, said speedometer module, said RFID module; and said braking module wherein said receiving module comprises a GPS receiver;

wherein said transmitting module comprises a GSM modem wherein said transmitting module receives signals from a traffic dispatch server;

wherein said speedometer module comprises a speedometer;

wherein said RFID module comprises an RFID aerial wherein said RFID aerial transmits signals from said controller to track-side transmission devices; and wherein said braking module receives signals from the brake in the rail vehicle and transmits same to said controller as well as receives signals from said controller to the rail vehicle's braking system; and said transmitting module, said RFID module and said braking module exchange data with said controller in two directions.

2. The device according to claim 1, wherein said controller is connected to the said GSM modem by a branch joint and a signal converter comprising an RS232 converter.

3. The device according to claim 1, wherein said controller is connected to said GPS receiver by means of a signal converter comprising an RS232 converter.

4. The device according to claim 1, wherein said controller is connected to the RFID aerial by means of a box, containing said RFID reader connected to an RS232 converter.

5. The device according to claim 2, wherein said branch joint is connected to two separate terminals.

* * * * *